US009577351B2

(12) United States Patent
Martin

(10) Patent No.: US 9,577,351 B2
(45) Date of Patent: Feb. 21, 2017

(54) SPRING LOADED INSULATION PIERCING ELECTRICAL CONNECTOR

(71) Applicant: Hubbell Incorporated, Shelton, CT (US)

(72) Inventor: Evan Martin, Derry, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/774,657

(22) PCT Filed: Mar. 14, 2014

(86) PCT No.: PCT/US2014/028367
§ 371 (c)(1),
(2) Date: Sep. 10, 2015

(87) PCT Pub. No.: WO2014/152949
PCT Pub. Date: Sep. 25, 2014

(65) Prior Publication Data

US 2016/0020529 A1 Jan. 21, 2016

Related U.S. Application Data

(60) Provisional application No. 61/781,547, filed on Mar. 14, 2013.

(51) Int. Cl.
*H01R 4/24* (2006.01)
*H01R 43/01* (2006.01)
*H01R 43/16* (2006.01)

(52) U.S. Cl.
CPC ..... *H01R 4/2404* (2013.01); *H01R 4/2408* (2013.01); *H01R 43/01* (2013.01); *H01R 43/16* (2013.01)

(58) Field of Classification Search
CPC .... H01R 4/2404; H01R 4/2408; H01R 43/01; H01R 43/16; H01R 43/02
USPC ..... 439/781, 782, 790, 801, 807, 810, 815, 439/479, 389, 391, 393, 395, 402, 403, 439/404, 408, 409, 410, 411, 412, 413, 439/415, 418, 423, 424, 428, 431, 439/432–434, 443
See application file for complete search history.

(56) References Cited

U.S. PATENT DOCUMENTS 4,684,196 A * 8/1987 Smith ..... H01R 4/2408 439/411
4,707,051 A * 11/1987 Hall ..... H01R 4/44 439/781
4,985,003 A * 1/1991 Francois ..... H01R 4/2408 439/475
7,666,024 B2 * 2/2010 De France ..... H01R 4/4872 439/479

* cited by examiner

*Primary Examiner* — Abdullah Riyami
*Assistant Examiner* — Harshad Patel
(74) *Attorney, Agent, or Firm* — Michael Best & Friedrich, LLP

(57) ABSTRACT

An electrical connector includes first and second pads. The first pad includes first and second grooves and the second pad includes third fourth grooves. A first insulation displacing contact extends from the first groove to the second groove. A second insulation displacing contact extends from the third groove to the fourth groove. The first and second pads are connected by a mechanical fastener. When the first and second pads are connected the first groove aligns with the third groove and the second groove aligns with the fourth groove.

18 Claims, 8 Drawing Sheets

SPRING LOADED INSULATION PIERCING ELECTRICAL CONNECTOR

FIELD OF THE INVENTION

The present invention relates generally to a spring-loaded electrical connector for electrically connecting various diameter first and second conductors.

BACKGROUND OF THE INVENTION

A power line clamp connector is used to make a permanent or temporary connection to an overhead power distribution line. For example, U.S. Pat. No. 3,075,166 to Peek discloses a conventional hot line clamp having a threaded eye bolt for adjusting a clamping member. One disadvantage associated with conventional power line clamp connectors is that complex maneuvering of a utility lineman's hot stick is required to manipulate an eyebolt of the clamp to connect to the conductors. As maintenance and installation operations become increasingly difficult, the added time required for these operations can increase operating costs for the utility company.

Parallel cable clamps are configured to electrically connect a main conductor to a tap conductor running parallel to the main conductor. A parallel cable clamp typically includes a top half and a bottom half, each having a first groove for receiving the main conductor and a second groove for receiving the tap conductor. The top and bottom halves are typically held together by a mechanical fastener.

SUMMARY OF THE INVENTION

In accordance with an exemplary embodiment, an electrical connector includes a first pad, a second pad, a fastener, and a spring member. The first pad has a first groove and a second groove. An electrically conductive first insulation displacing contact is positioned in the first groove. An electrically conductive second insulation displacing contact is positioned in the second groove and electrically connected to the first insulation displacing contact. An opening extends through the first pad between the first groove and the second groove. The second pad has a third groove and a fourth groove. An electrically conductive third insulation displacing contact is positioned in the third groove. An electrically conductive fourth insulation displacing contact positioned in the fourth groove, and electrically connected to the third insulation displacing contact. A slot extends through the second pad between the third groove and the fourth groove. The fastener extends through the opening and the slot to connect the first pad and the second pad, aligning the first groove with the third groove and the second groove with the fourth groove. The spring member is positioned around the fastener biasing the first pad and the second pad towards one another. The second pad is pivotable with respect to the first pad.

In accordance with another exemplary embodiment, an electrical connector includes a first pad, a second pad, a fastener, a washer, a nut, and a spring member. The first pad has a first groove and a second groove. An electrically conductive first insulation displacing contact extends from the first groove to the second groove. An opening extends through the first pad between the first groove and the second groove. The second pad has a third groove and a fourth groove. An electrically conductive second insulation displacing contact extends from the third groove to the fourth groove. A slot extends through the second pad between the third groove and the fourth groove. The fastener extends through the opening and the slot to connect the first pad and the second pad, aligning the first groove with the third groove and the second groove with the fourth groove. The washer is disposed on the fastener and the nut is threadably connected to the fastener. The spring member is positioned around the fastener between the washer and the nut biasing the first pad and the second pad towards one another. The second pad is pivotable with respect to the first pad.

In accordance with another exemplary embodiment, an electrical connector includes a first pad, a second pad, and a fastener. The first pad has a first top surface, a first end, a second end, a first side, and a second side. A first flange extends adjacent the first end. A first leg extends adjacent the second end. The first pad also has a first groove, a second groove, and an electrically conductive first insulation displacing contact extending from the first groove to the second groove. An opening extends through the first pad between the first groove and the second groove. The second pad has a second top surface, a third end, a fourth end, a third side, and a fourth side. The second flange extends adjacent the third end. The second leg extends adjacent the fourth end. The second pad also has a third groove, a fourth groove, and an electrically conductive second insulation displacing contact extending from the third groove to the fourth groove. A slot extends through the second pad between the third groove and the fourth groove. A fastener extends through the opening and the slot to connect the first pad and the second pad.

In accordance with an additional exemplary embodiment is a method of electrically connecting a pair of insulated conductors. An electrical connector is positioned adjacent to an insulated secondary conductor. Pressure is applied to at least one of a first leg and a second leg of the electrical conductor to pivot a second pad with respect to a first pad. A secondary conductor is inserted into a secondary conductor groove of the electrical conductor. The electrical connector is positioned so that an insulated primary conductor is positioned between the first leg and the second leg. The primary conductor is slide against the first leg and the second leg to cause the second pad to pivot with respect to the first pad and the primary conductor to be inserted into the primary conductor groove.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation.

BRIEF DESCRIPTION OF THE DRAWINGS

The above aspects and features of the present invention will be more apparent from the description for the exemplary embodiments of the present invention taken with reference to the accompanying drawings, in which.

DETAILED DESCRIPTION OF EXEMPLARY EMBODIMENTS

The drawings depict an exemplary electrical connector 20 to connect a first conductor 22, for example a main or run conductor with a second conductor 24, for example a tap conductor. The electrical connector 20 is a spring loaded electrical connector similar to that described in U.S. Pat. No. 7,666,024, the disclosure of which is hereby incorporated by reference in order provide greater detail or to describe additional aspects, but is in no way meant to limit or contradict the disclosure set forth herein. Although the exemplary embodiments of the present invention are described with regard to electrically connecting a tap conductor to a run conductor of an overhead power distribution system, the present invention is equally applicable to electrically connecting any two conductors. It should be understood that any combination of conductor types or sizes may be accommodated.

Figure 1:
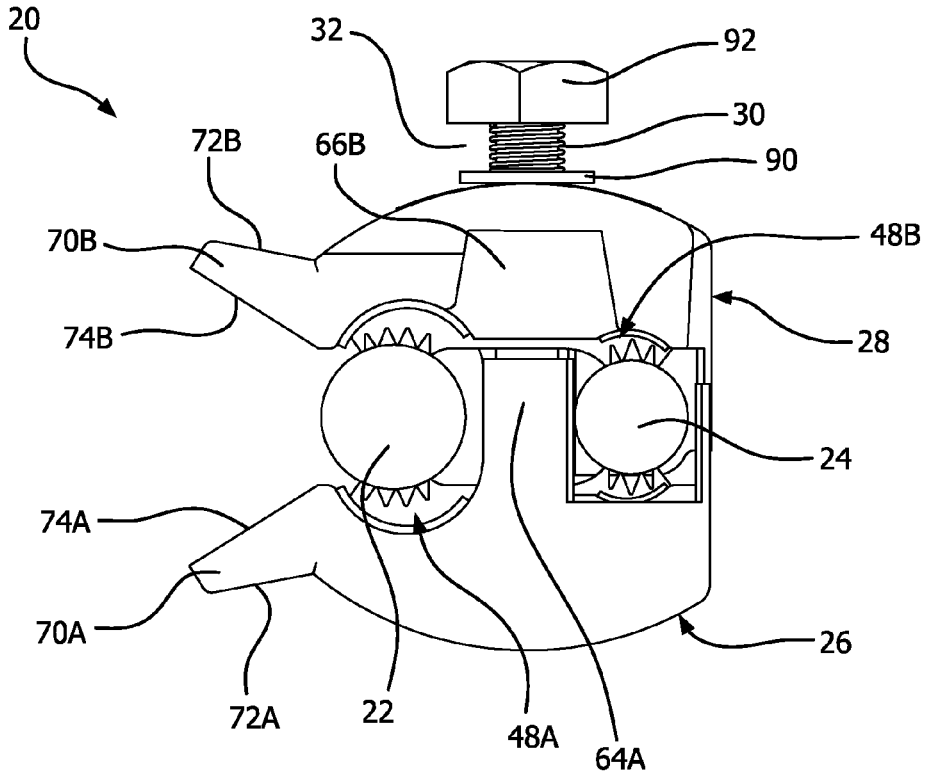
FIG. 1 is a left side elevational view of an electrical connector in accordance with an exemplary embodiment of the present invention with a first conductor and a second conductor positioned in the connector.
Figure 2:
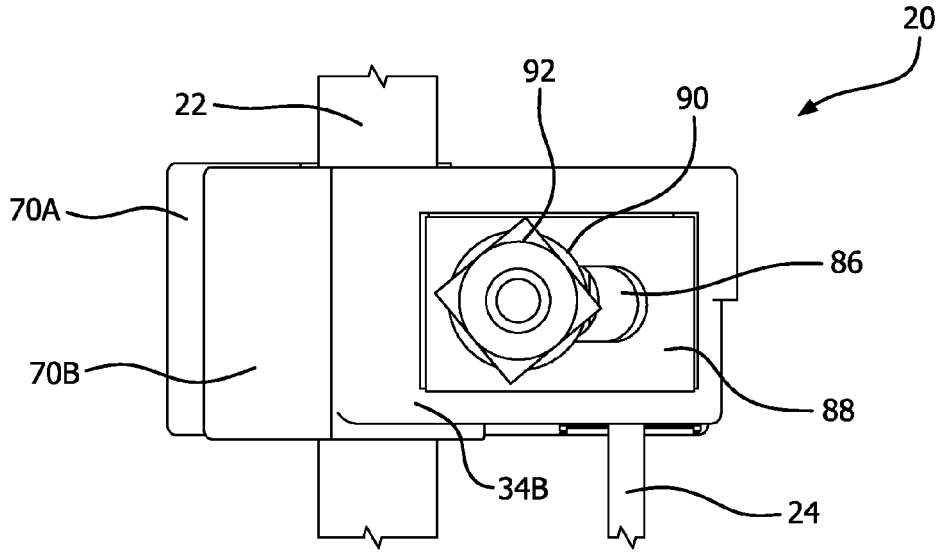
FIG. 2 is a top elevational view of the electrical connector of FIG. 1 with a first conductor and a second conductor positioned in the connector.

FIGS. 1 and 2 depict the electrical connector 20 receiving a first conductor 22 and a second conductor 24. The electrical connector 20 includes a first pad 26, a second pad 28, a spring member 30, and a fastener 32. The fastener 32 secures the spring member 30 against the second pad 28 to bias the first and second pads 26, 28 toward one another. The spring member 30 also provides a clamping force to secure the first and second conductors 22, 24 between the first and second pads 26, 28.

Figure 5:
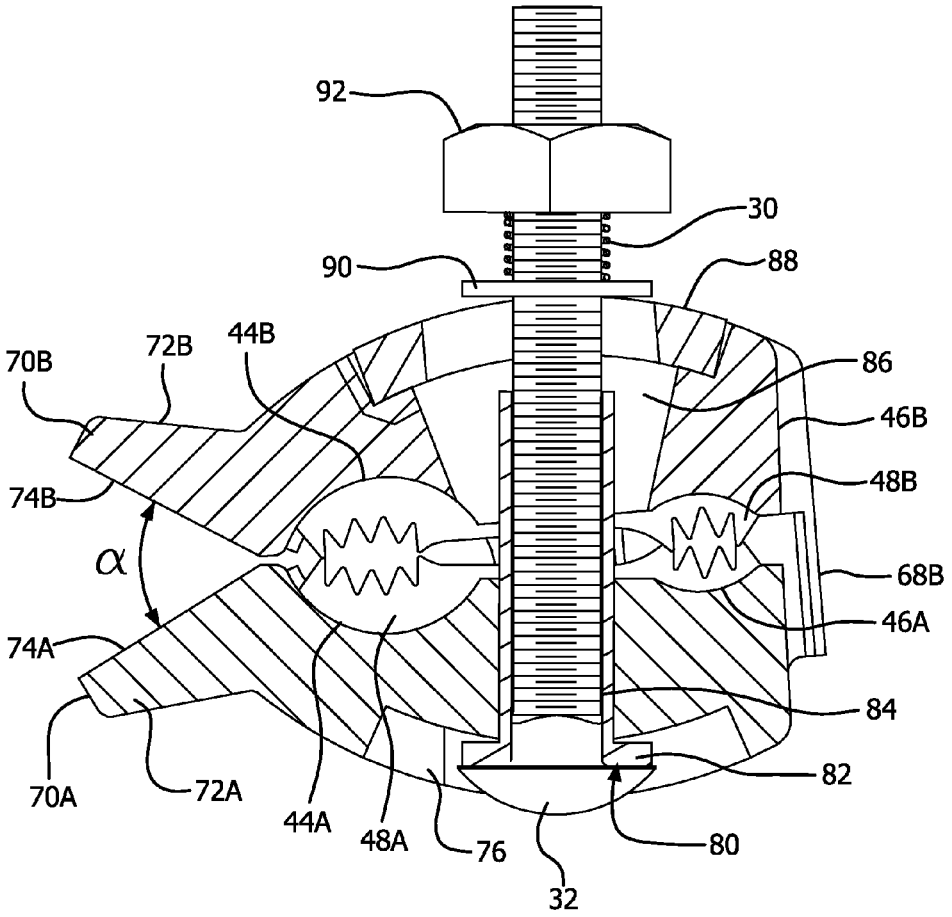
FIG. 5 is a side elevational view in section of the electrical connector of FIG. 4 taken along line 5-5.
Figure 6:
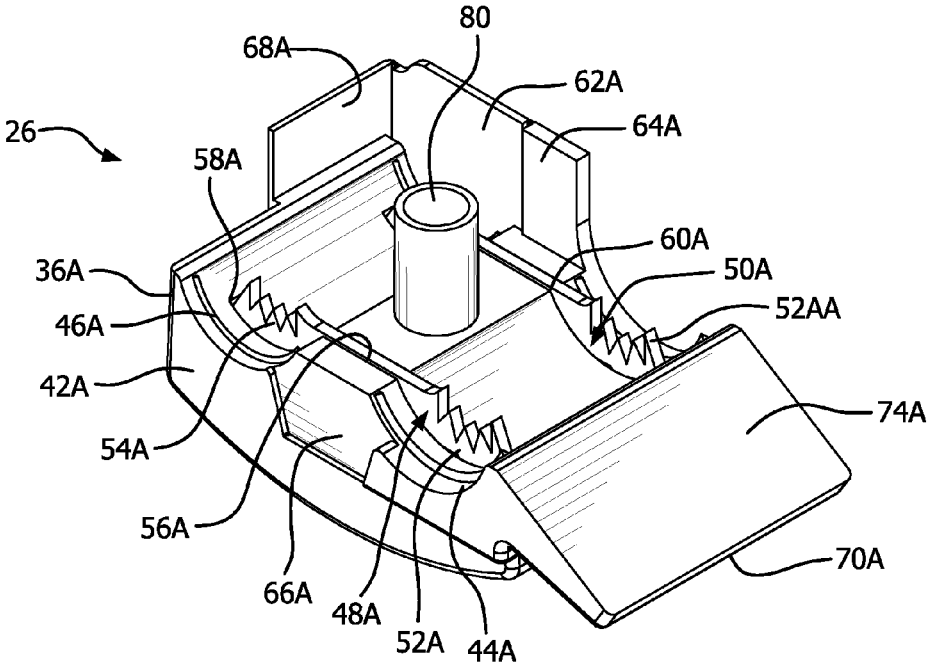
FIG. 6 is a top perspective view of a first pad of the electrical connector of FIG. 1.

The first pad 26 includes a top surface 34A, a first end 36A, a second end 38A, a first side 40A and a second side 42A. The first pad 26 may be a one-piece member. Although the first pad 26 may be fabricated from an electrically conductive material, for example metal, or from a non-electrically conductive material, such as a polymer or composite material. The first pad 26 includes a first conductor groove 44A and a second conductor groove 46A. The first and second conductor grooves 44A, 46A are substantially parallel to one another and are configured to receive the first and second conductors 22, 24, respectively. The first and second conductor grooves 44A, 46A are arcuate or partially cylindrical grooves extending from the first side 40A to the second side 42A. As best shown in FIGS. 5 and 6, the first conductor groove 44A is larger than the second conductor groove 46A. In various exemplary embodiments, the size, shape, length, and orientation of the first and second conductor grooves 44A, 46A may vary, for example, depending on the type of conductors to be connected and the direction in which the conductors are to run.

The first and second conductor grooves 44A, 46A include at least one insulation displacing contact 48A. As shown in FIG. 6 the first and second conductor grooves 44A, 46A each include first and second electrically conductive insulation displacing contact 48A, 50A. Each insulation displacing contact 48A, 50A includes a first set of teeth 52A, 52AA a second set of teeth 54A, 54AA and a central portion 56A bridging the first and second set of teeth 52A-AA, 54A-AA. Each insulation displacing contact 48A, 50A extends from the first conductor groove 44A to the second conductor groove 46A. The first and second insulation displacing contacts 48A, 50A are depicted as single piece or unitary contacts that create an electrical connection between the first and second conductor grooves 44A, 46A, although a multi-piece contact may also be used. The insulation displacing contacts 48A, 50A facilitate engaging an insulated conductor 22, 24 and displacing the insulation. In certain applications, the teeth 52A, 54A are designed to pierce the insulation of a respective conductor 22, 24. The first pad 26 may include a pair of slots 58A, 60A to receive the pair of insulation displacing contacts 48A, 50A or the insulation displacing contacts 48A, 50A may be formed integrally with the first pad 26. The electrical connector 20 also may be used with conductors 22, 24 that do not have insulation, and the insulation displacing contacts 48A, 50A may be used to grip or retain the conductor 22, 24.

The first side 40A of the first pad 26 includes an outwardly extending first knock out 62A and an outwardly extending first tab 64A. The first knock out 62A may be left in place to locate and protect the exposed end of the second conductor 24 or it may be removed to allow the second conductor 24 to pass through the first side 40A of the connector 20. The second side 42A of the first pad 26 includes a first tab groove 66A. The first tab 64A and the first groove 66A are positioned between the first and second conductor grooves 44A, 46A. A first flange 68A extends proximate the first end 36A and along approximately half the length of the first end 36A. A first leg 70A having an outer surface 72A and an inner surface 74A extends from the second end 38A at an angle. The angle of the first leg 70A allows a user to grip the outer surface 72A and apply pressure to the first leg 70A, and also allows the first conductor 22 to slide along the inner surface 74A to enter the first conductor groove 44A. In an exemplary embodiment the first leg 70A extends at an angle of approximately 32 degrees relative to a longitudinal axis of the connector 20, although any suitable angle can be used.

Figure 7:
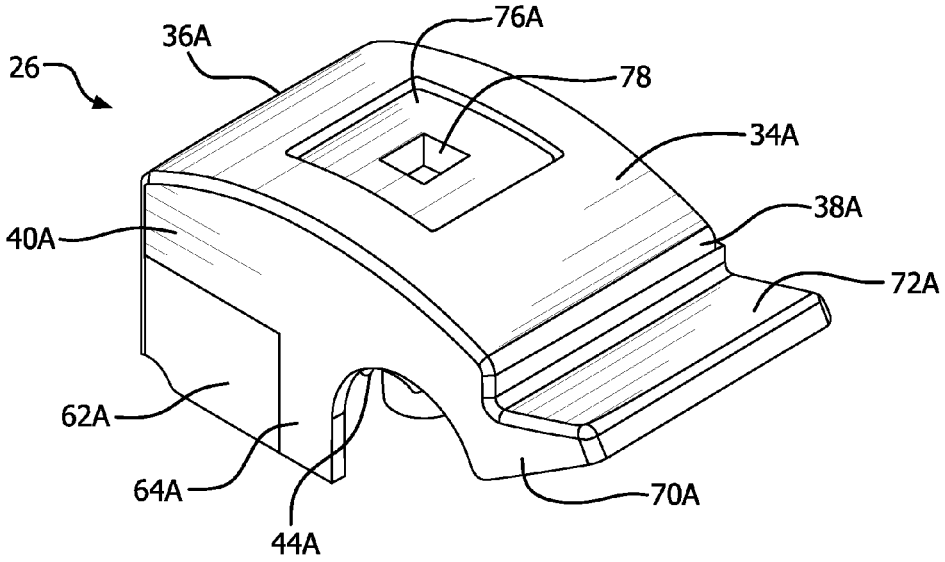
FIG. 7 is a bottom perspective view of a first pad of the electrical connector of FIG. 1.

As best shown in FIG. 7, the first pad 26 includes a first recess 76A on the top surface 34A. The first recess 76A surrounds an opening 78 that extends through the first pad 26. The opening 78 receives a sleeve 80 that extends through the first pad 26 and outwardly from the first pad 26. The sleeve 80 has a radially extending flange 82 and a hollow cylindrical body 84 extending from the flange 82. The sleeve 80 receives the fastener 32, and the first recess 76A receives the head of the fastener 32 and the sleeve flange 82. The first recess 76A has a substantially square shape, although any size and shape may be used and may be varied depending on the type of sleeve 80 or the type of fastener 32. The sleeve 80 may also vary in size and shape depending on the type of fastener 32 used to connect the first and second pads 26, 28. In various exemplary embodiments, the sleeve 80 may be integrally formed with the first pad 26.

Figure 8:
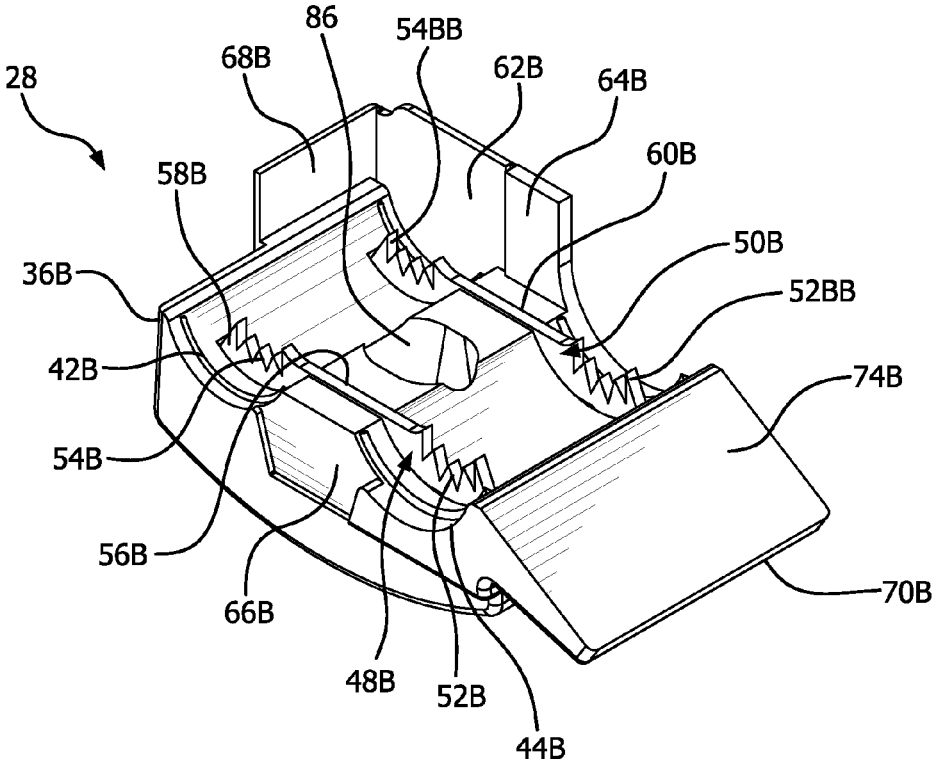
FIG. 8 is a bottom perspective view of a second pad of the electrical connector of FIG. 1.

The second pad 28 includes a top surface 34B, first end 36B, a second end 38B, a first side 40B, and a second side 42B. The second pad 28 may be a one-piece, unitary member. The second pad 28 may be fabricated from an electrically conductive material, for example metal, or a non-conductive material such as a polymer or composite material. The second pad 28 includes a first conductor groove 44B and a second conductor groove 46B. The first and second conductor grooves 44B, 46B are substantially parallel to one another and are configured to receive the first and second conductors 22, 24, respectively. The first and second conductor grooves 44B, 46B are arcuate or partially cylindrical grooves extending from the first side 40B to the second side 42B. As best shown in FIGS. 5 and 8, the first conductor groove 44B is larger than the second conductor groove 46B. In various exemplary embodiments, the size, shape, length, and orientation of the first and second conductor grooves 44B, 46B may vary, for example, depending on the type of conductors 22, 24 to be connected and the direction in which the conductors 22, 24 are to run. The first and second conductor grooves 44A, 46A of the first pad 26 are configured to align with the first and second conductor grooves 44B, 46B of the second pad 28 when the first and second pads 26, 28 are attached to one another.

The first and second conductor grooves 44B, 46B include at least one insulation displacing contact 48B. As shown in FIG. 8 the first and second conductor grooves 44B, 46B each include first and second electrically conductive insulation displacing contact 48B, 50B. Each insulation displacing contact 48B, 50B includes a first set of teeth 52B, 52BB, a second set of teeth 54B, 54BB, and a central portion 56B bridging the first and second set of teeth 52B-BB, 54B-BB. Each insulation displacing contact 48B, 50B extends from the first conductor groove 44B to the second conductor groove 46B. The first and second insulation displacing contacts 48B, 50B are depicted as single piece contacts that create an electrical connection between the first and second conductor grooves 44B, 46B, although a multi-piece contact may also be used. The insulation displacing contacts 48B, 50B facilitate engaging an insulated conductor 22, 24 and displacing the insulation. In certain applications, the teeth 52B, 54B are designed to pierce the insulation of a respective conductor. The second pad 28 may include a pair of slots 58B, 60B to receive the pair of insulation displacing contacts 48B, 50B or the insulation displacing contacts 48B, 50B may be formed integrally with the second pad 26. The electrical connector 20 may be used with conductors 22, 24 that do not have insulation, and the insulation displacing contacts 48B, 50B may be used to grip or retain the conductor.

The first side 40B of the second pad 28 includes an outwardly extending second knock out 62B and an outwardly extending second tab 64B. The second knock 62B out may be left in place to locate and protect the exposed end of the second conductor 24 or it may be removed to allow the second conductor 24 to pass through the first side 40B of the connector 20. The second side 42B of the second pad 28 includes a second tab groove 66B. The second tab 64B and the second groove 66B are positioned between the first and second conductor grooves 44B, 46B. A second flange 68B extends proximate the first end 36B and along approximately half the length of the first end 36B. A second leg 70B having an outer surface 72B and an inner surface 74B extends from the second end 38B at an angle. The angle of the second leg 70B allows a user to grip the outer surface 72B and apply pressure to the second leg 70B, and also allows a first conductor 22 to slide along the inner surface 74B to enter the first conductor groove 44B. In an exemplary embodiment the second leg 70B extends at an angle of approximately 32 degrees, although any suitable angle can be used.

Figure 9:
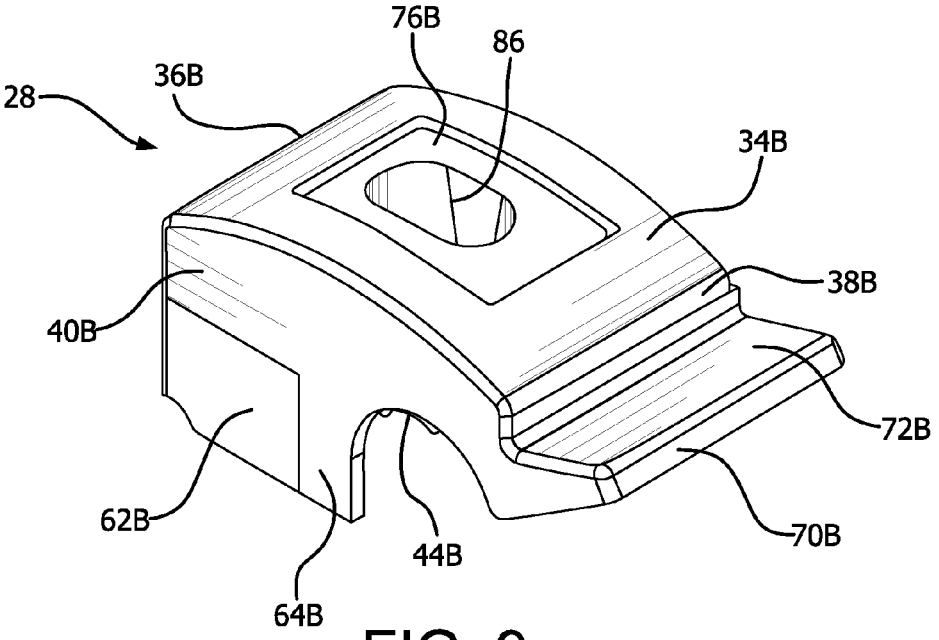
FIG. 9 is a top perspective view of a second pad of the electrical connector of FIG. 1.

As best shown in FIGS. 5 and 7, the second pad 28 includes a slot 86 that extends through the second pad 28. The slot 86 receives the sleeve 80 and the fastener 32 extending from the first pad 26. As best shown in FIG. 9, the slot 86 has a substantially obround opening, although any shape may be used. As best shown in FIG. 5, the slot 86 may taper in width as it extends through the second pad 28. The slot 86 provides space for the second pad 28 to pivot with respect to the first pad 26 around the fastener 32 and the sleeve 80.

A second recess 76B in the top surface 34B of the second pad 28 surrounds the slot 86. The second recess 76B receives an insert 88 disposed on the fastener 32. The insert 32 may be an elastomeric material, although other materials such as metal and composites may be used depending on the application. A washer 90 is disposed on the fastener 32 and contacts the insert 88. The end of the fastener 32 may receive a nut 92. The spring member 30 is disposed on the fastener 32 between the washer 90 and the nut 92. In various exemplary embodiments the insert 88 may be omitted and the washer 90 may be positioned in the second recess 76B. The second recess 76B has a substantially rectangular shape, although any size and shape may be used and may be varied depending on the type of fastener used.

Figure 10:
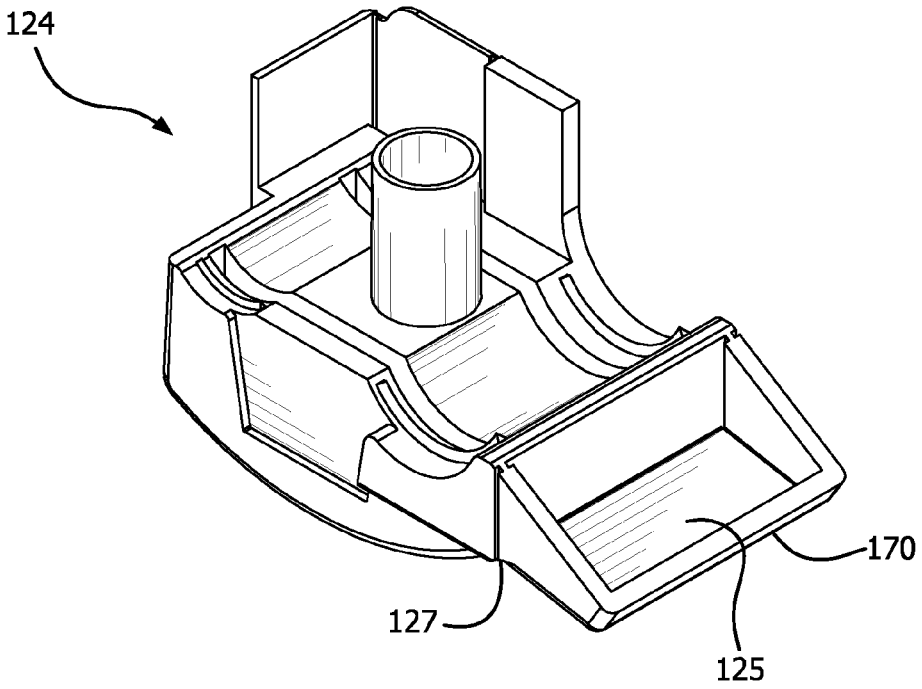
FIG. 10 is a perspective view of a pad of an electrical connector in accordance with a second exemplary embodiment of the present invention.
Figure 11:
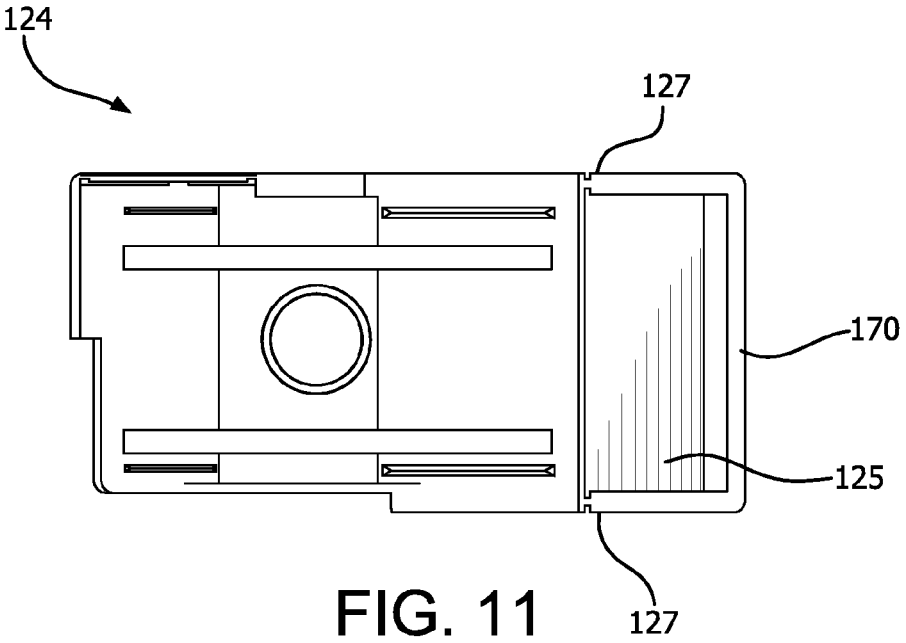
FIG. 11 is a top perspective view of the pad of FIG. 10.

A pad 124 in accordance with a second exemplary embodiment of the present invention is shown in FIGS. 10 and 11. The pad 124 is substantially similar to the first pad 26 of the first exemplary embodiment such that similar features will not be described below for brevity. A leg 170 extends from the second end 138 of the pad 124. The leg 170 has a hollow region 125 and is connected to the second end 138 of the pad 124 by a separable portion 127. In the exemplary embodiment depicted, the separable portion 127 includes an area of reduced thickness. In various alternative embodiments, the separable portion 127 may be any suitable means to facilitate separating the leg 170 from the body of the pad 124, such as a weakened area, frangible portion, perforations, or score lines. The leg 170 can be separated from the body by snapping, cutting or breaking at the separable portion after installation. The separable portion 127 is sufficiently strong such that it does not break during installation to inhibit connecting the conductors thereto. The leg 170 can be removed when installing the clamp in a confined location having limited space available. The leg of the second clamp can have a similar separable portion (not shown) to facilitate its removal.

Figure 3:
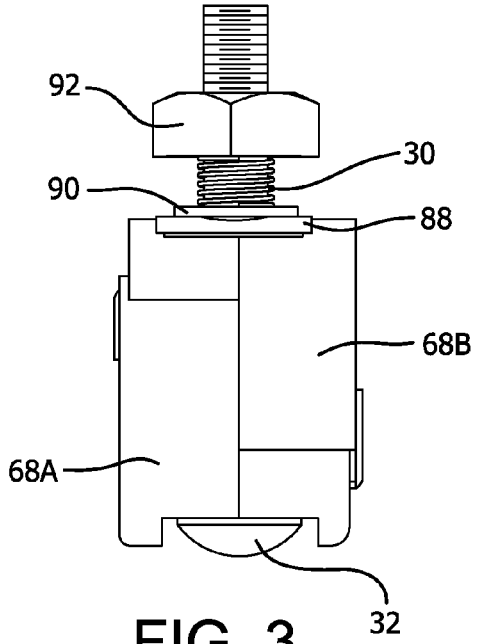
FIG. 3 is a front elevational view of the electrical connector of FIG. 1.
Figure 4:
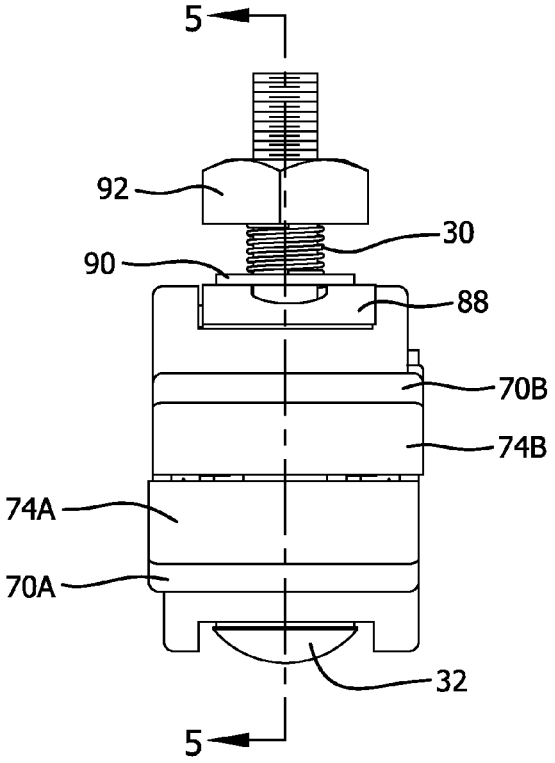
FIG. 4 is a rear elevational view of the electrical connector of FIG. 1.

In operation, the first and second pads 26, 28 are assembled together to form a spring-loaded connector. When assembled, the first tab 64A of the first pad 26 fits in the second groove 66B of the second pad 28 and the second tab 64B of the second pad 28 fits in the first groove 66A of the second first pad 26. As best shown in FIG. 3, the first and second flanges 68A, 68B align so that the second conductor 24 is covered and a substantially smooth surface is provided for the first ends 36A, 36B. The first conductor grooves 44A, 44B are aligned to form a receiving area for the first conductor 22. The second conductor grooves 46A, 46B are aligned to form a receiving area for the second conductor 24. The sleeve 80 extends through the opening 78 in the first pad 26 and into the slot 86 in the second pad 28. The fastener 32 extends through the sleeve 80 in the first pad 26 and through the slot 86 and insert 88 in the second pad 28. In certain embodiments, the sleeve 80, the insert 88, or both may be omitted. A washer 90 is placed over the fastener 32 and in contact with the insert 88. A spring member 30 is then placed over the fastener 32 and a nut 92 is threaded onto the end of the fastener 32, capturing the spring member 30 between the nut 92 and the washer 90. The term spring member 30 is used herein to refer to any type of biasing member or mechanism. In an exemplary embodiment, the spring member 30 is a compression coil spring.

The spring member 30 captured between the nut 92 and the washer 90 applies pressure against the second pad 28, forcing or biasing the first and second pads 26, 28 together. The first and second pads 26, 28 can be separated by overcoming the pressure exerted by the spring member 30 to allow for installation of the conductors 22, 24 between the conductor grooves 44A-B, 46A-B of the first and second pads 26, 28. As the first and second pads 26, 28 are forced against each other by the spring member 30, pressure is created on the conductors 22, 24 such that the insulation displacing contacts 48A-B, 50A-B engage the conductors 22, 24 to secure the conductors 22, 24 in the conductor grooves 44A-B, 46A-B. The force of the spring member 30 may also be sufficient for the teeth 52A, 52B, to pierce the insulation of the conductor 22, 24.

When the first and second pads 26, 28 are assembled, the inner surfaces 72A, 72B of the first and second legs 70A, 70B form a substantially V-shaped opening. The V-shaped opening has an angle $\alpha$ formed between inner surfaces 72A, 72B of the first and second legs 70A, 70B as shown in FIG. 5. The angle $\alpha$ is an acute angle of, for example, approximately 64 degrees, although any angle $\alpha$ can be formed, including a 90 degree angle or greater. Preferably the angle $\alpha$ is less than 180 degrees. The angle $\alpha$provides a lead-in feature for insertion of the first conductor 22 between the first conductor grooves 44A, 44B.

Figure 12:
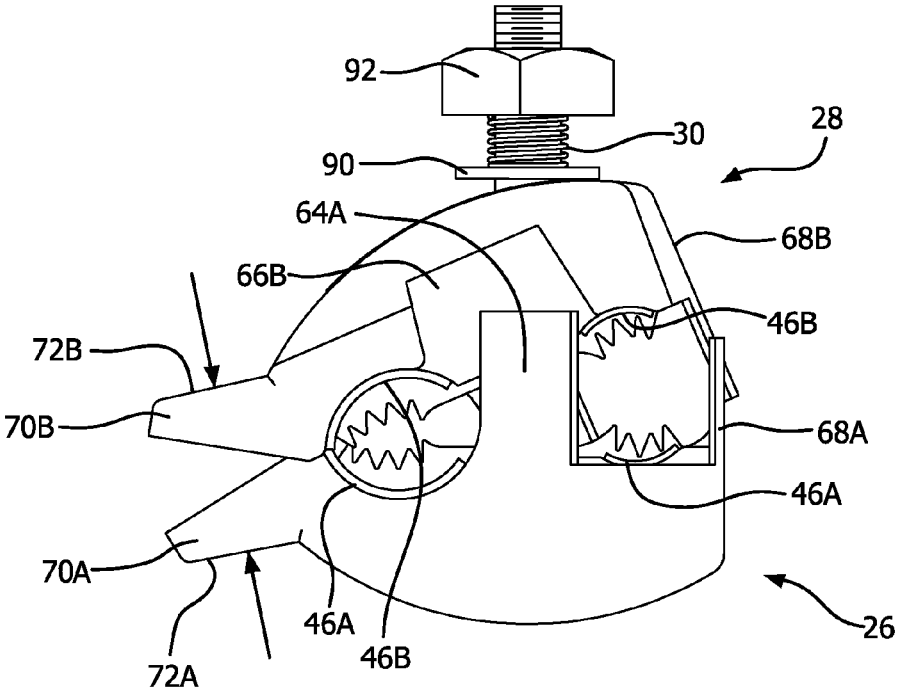
FIG. 12 is a left side elevational view of the electrical connector of FIG. 1 during insertion of a tap conductor.

As best shown in FIG. 12, by applying force to the first and second legs 70A, 70B, the force exerted by the spring member 30 is overcome such that the second pad 28 pivots about a contacting portion of the inner surfaces 74A, 74B of the first and second pads 26, 28, thereby separating the second conductor grooves 46A, 46B. The slot 86 in the second pad 28 allows for pivotal movement of the second pad 28 relative to the first pad 26 and the fastener 32. The movement of the second pad 28 occurs while keeping the spring member 30 captive. The first and second pads 26, 28 are movable apart a suitable distance to allow installation of the second conductor 24 between the second conductor grooves 46A, 46B of the first and second pads 26, 28. Releasing the first and second legs 70A, 70B causes the spring member 30 to snap the second pad 28 shut with respect to the first pad 26, thereby securing the second conductor 24 in the second conductor grooves 46A, 46B. The insulation displacing contacts 48A-B, 50A-B facilitate retaining the second conductor 24 between the first and second pads 26, 28. The spring member 30 may apply enough force for the teeth 52A, 52B to pierce the insulation of an insulated second conductor 24, particularly when the nut is threaded on the fastener 32, to increase the force of the spring member 30, or the connector 20 may be compressed by a user to pierce the insulation. In operation, the second or tap conductor 24 may be inserted into the connector first and then the connector 20 may be placed adjacent a first or main conductor 22 with a hot stick (not shown) or other suitable utility lineman's pole. Prior to insertion of the second conductor 24, one or more of the first and second knock outs 62A, 62B may be removed. If one of the knock outs 62A, 62B is retained, the end of the second conductor 24 may be seated against the remaining knock out 62A, 62B.

Figure 13:
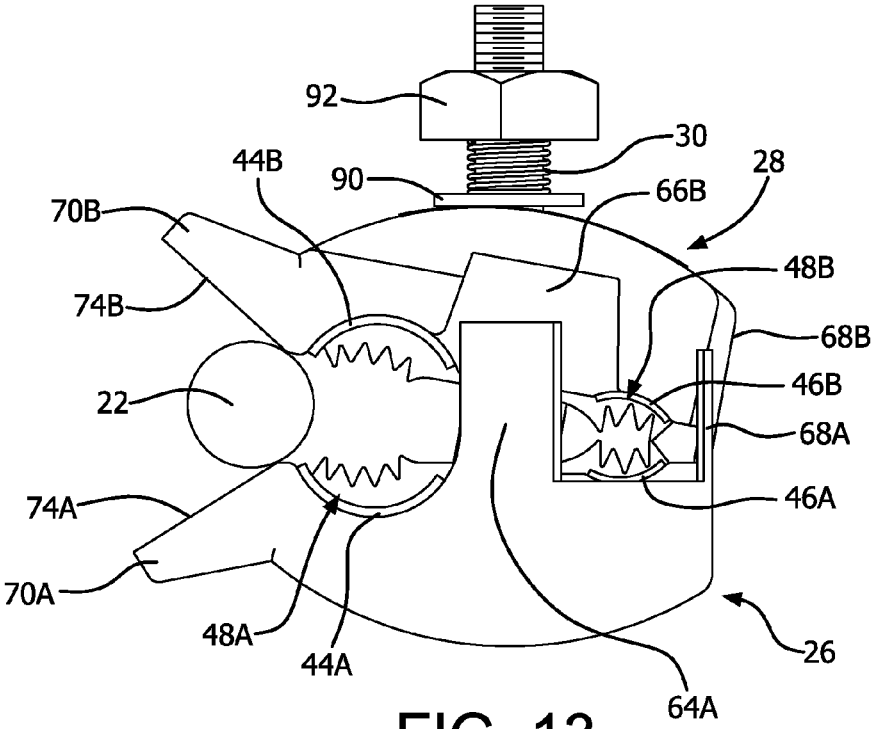
FIG. 13 is a left side elevational view of the electrical connector of FIG. 1 during insertion of a main conductor.

As shown in FIG. 13, the first conductor 22 is inserted in the clamp by pushing the first conductor 22 against the inner surfaces 74A, 74B of the first and second legs 70A, 70B. The force exerted by the first conductor 22 against the inner surfaces 74A, 74B overcomes the force of the spring member 30 and causes the second pad 28 to pivot away from the first pad 26. The second pad 28 pivots about an area proximate the flanges 68A, 68B of the first and second pads 26, 28. If the second conductor 24 is positioned in the second conductor groves 46A, 46B, the second pad 28 may pivot about the conductor. The first conductor 22 can then be slid between the first conductor grooves 44A, 44B. Once the first conductor is seated in the first conductor grooves 44A, 44B, the force exerted by the spring member 30 then causes the second pad 28 to pivot back toward the first pad 26, thereby clamping shut such that the insulation piercing contacts 48A-B, 50A-B engage and secure the first conductor 22 in the first conductor grooves 44A, 44B. The spring member 30 may apply enough force for the teeth 52A-B, 54A-B to pierce the insulation of an insulated first conductor 22, particularly when the nut is threaded on the fastener 32, or the connector 20 may be compressed by a user to pierce the insulation. The insulation piercing contacts 48A-B, 50A-B provide an electrical path through the connector 20 between the received first and second conductors 22, 24. Although, the second conductor 24 is typically inserted first, followed by connecting the clamp to the first conductor 22, in certain embodiments a user may insert the first conductor 22 and then the second conductor 24.

Figure 14:
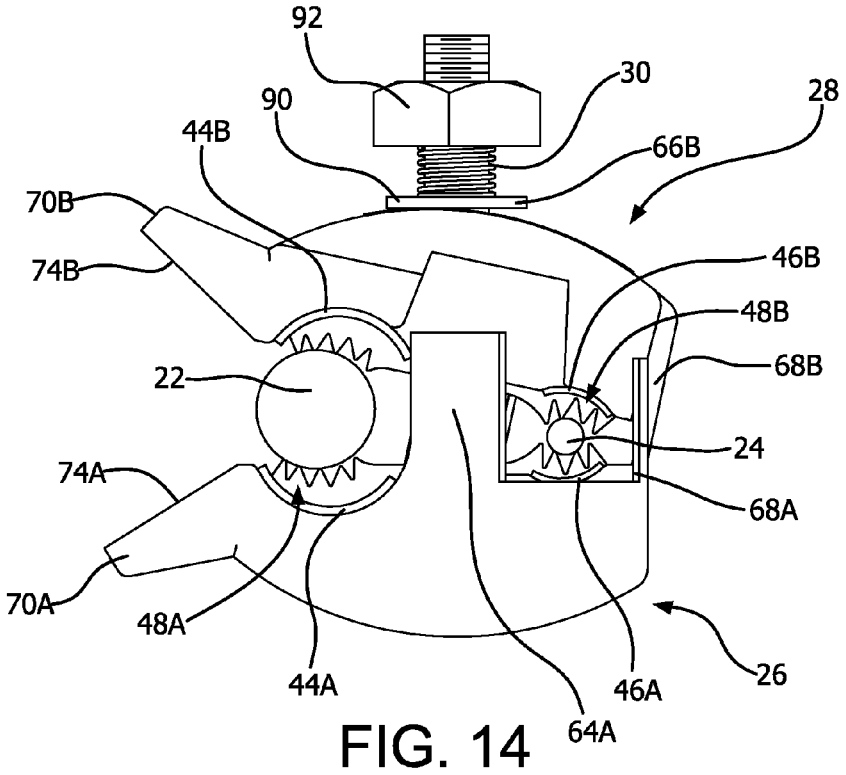
FIG. 14 is a left side elevational view of the electrical connector of FIG. 1 receiving a maximum sized main conductor and a minimum sized tap conductor.
Figure 15:
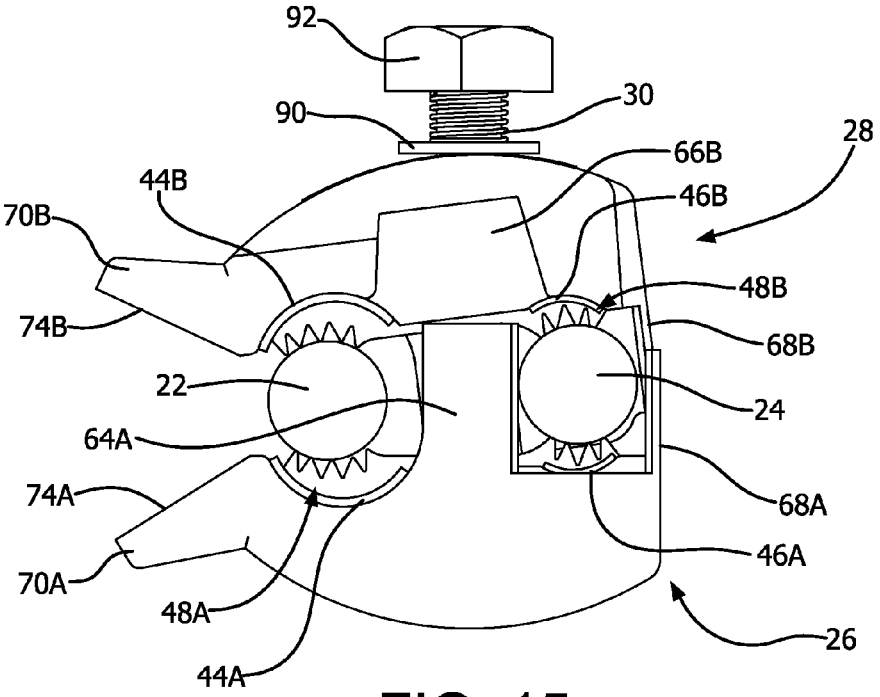
FIG. 15 is a left side elevational view of the electrical connector of FIG. 1 receiving a minimum sized main conductor and a maximum sized tap conductor.

As shown in FIGS. 1, 14, and 15, the spring member 30 and the slot 86 in the second pad 28 allow the connector 20 to receive various diameter first and second conductors 22, 24. As shown in FIG. 1, the nut 92 on the fastener 32 can be rotated to an end thereof, thus allowing the connector 20 to receive maximum diameter first and second conductors 22, 24. As shown in FIG. 14, the nut 92 can be rotated toward the top surface 34B of the second pad 28 and the second pad 28 can be pivoted, thereby allowing the connector 20 to receive a maximum diameter first conductor 22 and a minimum diameter second conductor 24. As shown in FIG. 15, the second pad 28 can be pivoted with respect to the first pad 26 and the fastener 38 in the opposite direction as in FIG. 14, thereby allowing the connector 20 to receive a minimum diameter first conductor 22 and a maximum diameter second conductor 24. The first and second tabs 64A, 64B extend downwardly from the first and second pads 26, 28, respectively, to maintain alignment of the first and second pads 26, 28 as the second pad 28 pivots with respect to the first pad 26.

The installation described above may be accomplished by attaching a utility lineman's hot stick to an end of the fastener 32 and/or the nut 92 extending from the second pad 28; such as by screwing on to the end of the bolt for example. Various types of mechanical fasteners 32 may used in any of the embodiments described above, including those having hooks or eyelets. The disclosed configuration provides a spring-loaded connector that can be easily installed (when compared to conventional configurations) to connect a tap line to an overhead power distribution line on a utility pole using a utility lineman's hot stick.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

What is claimed:

1. An electrical connector comprising:

a first pad having a first groove, a second groove, an electrically conductive first insulation displacing contact positioned in said first groove, an electrically conductive second insulation displacing contact positioned in said second groove and electrically connected to said first insulation displacing contact, and an opening extending through said first pad between said first groove and said second groove;

a second pad having a third groove, a fourth groove, an electrically conductive third insulation displacing contact positioned in said third groove, an electrically conductive fourth insulation displacing contact positioned in said fourth groove and electrically connected to said third insulation displacing contact, and a slot extending through said second pad between said third groove and said fourth groove;

a fastener extending through said opening and said slot to connect said first pad and said second pad, aligning said first groove with said third groove and said second groove with said fourth groove;

a spring member positioned around said fastener biasing said first pad and said second pad towards one another, said second pad being pivotable with respect to said first pad; and a sleeve extending through said opening and into said slot receiving said fastener.

2. The electrical connector of claim 1 wherein said first insulation displacing contact and said second insulation displacing contact are a unitary structure connected by a central portion.

3. The electrical connector of claim 1 wherein said spring biases said second pad towards said first pad.

4. The electrical connector of claim 1 wherein the sleeve includes a flange and a hollow cylindrical body.

5. The electrical connector of claim 1 wherein a washer is positioned around said fastener and a nut is threaded onto said fastener, said spring being positioned between said nut and said washer.

6. An electrical connector comprising:

a first pad having a first groove, a second groove, an electrically conductive first insulation displacing contact extending from said first groove to said second groove, and an opening extending through said first pad between said first groove and said second groove;

a second pad having a third groove, a fourth groove, an electrically conductive second insulation displacing contact extending from said third groove to said fourth groove, and a slot extending through said second pad between said third groove and said fourth groove;

a fastener extending through said opening and said slot to connect said first pad and said second pad, aligning said first groove with said third groove and said second groove with said fourth groove;

a washer disposed on said fastener;

a nut threadably connected to said fastener;

a spring member positioned around said fastener between said washer and said nut biasing said first pad and said second pad towards one another, said second pad being pivotable with respect to said first pad; and a sleeve, having a flange received by said first recess and a hollow cylindrical body extending through said opening, receiving said fastener.

7. The electrical connector of claim 6 wherein said first insulation displacing contact comprises a first set of teeth in said first conductor groove and a second set of teeth in said second conductor groove.

8. The electrical connector of claim 7 wherein said spring member applies force sufficient to cause at least one of said first set of teeth and said second set of teeth to pierce the insulation of an insulated conductor.

9. The electrical connector of claim 6 wherein said first pad has a top surface that includes a first recess surrounding said opening and said second pad includes a top surface that has a second recess surrounding said slot.

10. The electrical connector of claim 6 wherein rotation of said nut on said fastener adjusts the amount the second pad is capable of pivoting with respect to the first pad.

11. An electrical connector comprising:

a first pad having a first top surface, a first end, a second end, a first side, a second side, a first flange extending adjacent said first end, a first leg extending adjacent said second end, a first groove, a second groove, an electrically conductive first insulation displacing contact extending from said first groove to said second groove, an opening extending through said first pad between said first groove and said second groove, and a first knockout extending from said first side;

a second pad having a second top surface, a third end, a fourth end, a third side, a fourth side, a second flange extending adjacent said third end, a second leg extending adjacent said fourth end, a third groove, a fourth groove, an electrically conductive second insulation displacing contact extending from said third groove to said fourth groove, a second knockout extending from said third side, and a slot extending through said second pad between said third groove and said fourth groove;

a fastener extending through said opening and said slot to connect said first pad and said second pad; and a sleeve extending through said opening and into said slot receiving said fastener.

12. The electrical connector of claim 11 wherein said first flange extends approximately half the length of said first end and said second flange extends approximately half the length of said third end.

13. The electrical connector of claim 12 wherein said first flange and said second flange at least partially horizontally align when said first pad is connected to said second pad.

14. The electrical connector of claim 11 wherein said first pad includes a first tab extending from said first side and a first groove in said second side and said second pad includes a second tab extending from said third side and a second groove in said fourth side, said first tab mating with said second groove and said second tab mating with said first groove when said first pad and said second pad are aligned.

15. The electrical connector of claim 11 wherein said first leg has a first inner surface and said second leg has a second inner surface angled with respect to the first inner surface and the angle between said first inner surface and said second inner surface is approximately 64 degrees.

16. The electrical connector of claim 11 wherein said first leg is connected to said second end by a separable portion.

17. An electrical connector comprising:

a first pad having a first top surface, a first end, a second end, a first side, a second side, a first flange extending adjacent said first end, a first leg extending adjacent said second end, a first groove, a second groove, an electrically conductive first insulation displacing contact extending from said first groove to said second groove, an opening extending through said first pad between said first groove and said second groove, and a first tab extending from said first side and a first groove in said second side;

a second pad having a second top surface, a third end, a fourth end, a third side, a fourth side, a second flange extending adjacent said third end, a second leg extending adjacent said fourth end, a third groove, a fourth groove, an electrically conductive second insulation displacing contact extending from said third groove to said fourth groove, a slot extending through said second pad between said third groove and said fourth groove, a second tab extending from said third side and a second groove in said fourth side, said first tab mating with said second groove and said second tab mating with said first groove when said first pad and said second pad are aligned; and a fastener extending through said opening and said slot to connect said first pad and said second pad.

18. An electrical connector comprising:

a first pad having a first top surface, a first end, a second end, a first side, a second side, a first flange extending adjacent said first end, a first leg extending adjacent said second end, a first groove, a second groove, an electrically conductive first insulation displacing contact extending from said first groove to said second groove, and an opening extending through said first pad between said first groove and said second groove;

a second pad having a second top surface, a third end, a fourth end, a third side, a fourth side, a second flange extending adjacent said third end, a second leg extending adjacent said fourth end, a third groove, a fourth groove, an electrically conductive second insulation displacing contact extending from said third groove to said fourth groove, and a slot extending through said second pad between said third groove and said fourth groove; and a fastener extending through said opening and said slot to connect said first pad and said second pad, wherein said first leg has a first inner surface and said second leg has a second inner surface angled with respect to the first inner surface and the angle between said first inner surface and said second inner surface is approximately 64 degrees.

* * * * *